United States Patent [19]

Landy

[11] 4,098,174

[45] Jul. 4, 1978

[54] TOTAL EXHAUST LAMINAR FLOW BIOLOGICAL FUME HOOD SAFETY CABINET AND METHOD

[76] Inventor: Jerome J. Landy, 13700 SW. 78 Ct., Miami, Fla. 33144

[21] Appl. No.: 675,257

[22] Filed: Apr. 8, 1976

[51] Int. Cl.[2] ..... B08B 15/02

[52] U.S. Cl. ..... 98/115 LH; 55/473; 55/DIG. 18; 55/DIG. 29

[58] Field of Search ..... 98/115 LH, 115 R, 36; 55/DIG. 29, DIG. 18, 385 A, 473

[56] References Cited

U.S. PATENT DOCUMENTS

| | | | |
|---|---|---|---|
| 3,000,292 | 9/1961 | Wojan | 98/115 LH |
| 3,273,323 | 9/1966 | Whitfield | 55/DIG. 9 |
| 3,340,788 | 9/1967 | Landingham et al. | 98/115 LH |
| 3,811,250 | 5/1974 | Fowler, Jr. | 98/115 LH X |
| 3,926,597 | 12/1975 | Landy | 98/115 LH X |

*Primary Examiner*—William F. O'Dea

*Assistant Examiner*—Harold Joyce

*Attorney, Agent, or Firm*—Jack E. Dominik

[57] ABSTRACT

A total exhaust laminar flow biological fume hood safety cabinet is disclosed having a closed housing with a viewing panel and access port therebeneath at its front portion. Centrally a work tray is mounted with means permitting air passage thereabout. A plenum chamber connects the lower portion of the housing to the top, and an exhaust blower in closed pneumatic communication with the plenum delivers contaminated air to an exhaust filter for total exhaust. Makeup air means are provided at the upper portion of the housing to deliver filtered air downwardly over the work tray, and the blower capacities, flow rates, and filter capacities are developed to the end that the air passing through the access port exceeds the quantity of filtered makeup air while providing for an access air velocity at least double that of the makeup air velocity.

11 Claims, 3 Drawing Figures

TOTAL EXHAUST LAMINAR FLOW BIOLOGICAL FUME HOOD SAFETY CABINET AND METHOD

FIELD OF THE INVENTION

The subject invention is directed primarily to the handling of various biological specimens for examination in a laboratory. Particularly carcinogeous type material, or other toxic materials may be processed in the subject unit, by a trained pathologist or laboratory technician. In addition, the subject invention is directed to a cabinet of this character in which total exhaust is achieved, thereby eliminating the possibility of explosive type material such as ether being recirculated over the work tray.

SUMMARY OF THE PRIOR ART

The prior art is illustrated in J. J. Landy, U.S. Pat. No. 3,926,597, and also in devices such as that manufactured by Contamination Control, Incorporated, of Kulpsville, Pa. While both devices are capable of providing a degree of protection for the operator, they do not, because of the recirculating effect, virtually eliminate the possibility of an explosive environment existing interiorly of the cabinet. Until the present time, the equipment which is known has been limited to achieving one or more of the following objectives but not all:

1. The protection of all personnel from exposure to potentially contagious particulate materials such as bacteria, viruses, parasites, fungi, etc., by the use of HEPA filters and an air curtain;

2. Establishment of a work area bathed with laminar flowing sterile area for the protection of materials being handled;

3. Protection of personnel from noxious fumes, potential carcinogens, and potential explosive liquids and gases, as well as radioactive materials, by totally exhausting air from the chamber;

4. Providing for free ingress and egress of the hands of the operator at all times through a partially open front.

To achieve all of the above results, and in one particular cabinet construction, is the primary object of the present invention as will be set forth in greater detail below following the "Summary."

SUMMARY OF THE INVENTION

The present invention is directed to a unidirectional, mass-displaced, laminar flow air bathed work area, which joins with ambient air entering the cabinet through an access port, as a sufficient face foot velocity to provide for containment of airborne hazards within the unit. The ambient air is directed downwardly so that it does not pass over the work area and cannot contaminate the work in progress. Provision is made for an exhaust blower at the lower portion of the unit, and an inlet air blower at the top, and an interconnection and intercontrol of the same to vary their speeds empirically to the end that the ratio between the air moved by the lower or exhaust blower to the make-up air blower is greater than two to one. The filters are oriented in parallel relationship, and immediately adjacent each other. Means are further provided in the event the larger blower should fail to automatically shut off the smaller blower. Both the apparatus and the method of the present invention are directed to the above technique, and the construction disclosed for achieving the result.

In view of the foregoing it is a principal object of the present invention to provide, in a single cabinet, equipment which achieves the following results:

1. Protection of all personnel from exposure to potentially contagious particulate materials such as bacteria, viruses, parasites, fungi, and the like by the use of HEPA filter and an air curtain;

2. Establishing a work area bathed with laminar flow sterile area for the protection of the material being handled;

3. Protection of personnel from noxious fumes, potential carcinogens, potential explosive liquids and gases, radioactive materials and the like, by totally exhausting air from the chamber; and, 4. Maintaining the feature of free ingress and egress of the hands of the operator through a partially open access port, beneath a transparent viewing panel at the front portion of the cabinet.

Heretofore cabinets for handling biohazardous material have not been able to achieve all of the four results in a single unit, nor have the methods been available for achieving those results as well.

Another object of the present invention is to provide a cabinet achieving the foregoing objectives, in which a fail safe relationship exists between the larger blower and the smaller blower so that if the larger blower and/or its motor fails, the entire unit will be shut down.

Still another object of the present invention is to provide a chamber and method in which the flow rates can be empirically varied depending upon the particular environment, filter system, and exhaust system being employed.

Yet another object of the present invention is to provide a biohazardous full exhaust handling cabinet in which the parts may be readily disassembled for cleaning or decontamination. Yet another, and related object of the present invention is to provide such a cabinet and method in which the HEPA filters are readily removable.

Still another object of the present invention is to provide a cabinet and method in which the discharge may be filtered, or subsequently processed to deliver the same to a remote area thereby rendering the operator free of excessive contaminating exposure.

DESCRIPTION OF ILLUSTRATIVE DRAWINGS

Further objects and advantages of the present invention will become apparent as the following description of an illustrative embodiment of the apparatus and method proceeds, taken in conjunction with the accompanying illustrative drawings in which.

DESCRIPTION OF PREFERRED METHOD

Figure 3:
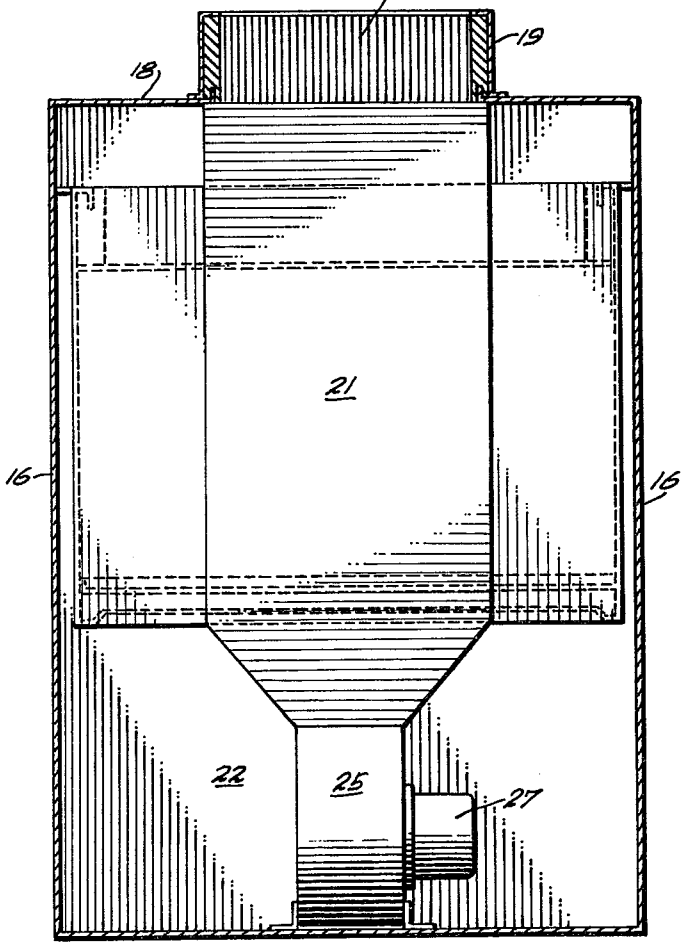
FIG. 3 is a lateral section view from the interior of the subject cabinet taken generally along section line 3—3 of FIG. 2, and in reduced scale therefrom.

Both the method and the apparatus of the invention will be better understood by first directing the description to the method. Essentially the method involves the purging of a work tray used for handling biohazardous as well as explosive materials. The work tray is first positioned in a confined vertical space, but with means for passing air around the periphery for the work tray. Thereafter air is delivered vertically downwardly and over the work tray, with particulate matter filtered from that air. The subject air is "make-up" type air.

In addition, a work opening is provided along one edge of the tray and over a pathway, the work opening being generally lateral to accommodate the lateral movement of the hands of the operator or technician. Beneath the work tray provision is made to achieve a negative pressure to draw the filtered air over the work tray, and yet to induce the make-up air over the work tray at one portion thereof to pass by the work opening. Because the negative pressure area beneath the work tray is confined in a vertical path, substantially parallel to the path of the filtered air, and since the ratio provided is at least two to one the flow rate of the make-up air, the ambient air passing through the work tray opening is constantly under a negative pressure, and therefore passes inwardly, shielding the make-up filtered air from passing outwardly after the same has been in contact with the material on the work tray. Thereafter the combination of work tray opening air as well as make-up air is the subject of positive pressure and delivered in a confined pathway vertically to an exhaust area, which subsequently is subjected to the further step of filtering the same. The net result, of course, is to thus, provide for filtered air to pass over the work tray, and yet have access for the hands of the operator, through an area accessible to ambient, and yet dictate the result of all of the air passing outwardly to a total exhaust from the area above the work tray. Since the work tray may include biohazardous materials, such as carcinogeous materials as well as emit noxious or explosives fumes, the provision for 100% total exhaust eliminates the possibility of such materials re-entering the area above the work tray. Furthermore, in order to "fail safe" the unit, the means for providing the exhaust and the maximum negative pressure beneath the work tray are coordinated with the means for delivering inlet air, to the end that if the exhaust means fail, the balance of the unit ceases operation and decontamination may begin. While the ratio of air flow of two to one between the exhaust and the make-up air has been set forth above, a ratio of three to one optimizes results. Ratios of less than two to one can cause the risk, particularly depending upon the motion of the arms and the hands of the operator, of some of the contaminated air over the work tray hitting the arms or hands and being deflected outwardly through the work access port. By providing for variable ratios between the pressures and flow-rates, the same can be adjusted empirically by the use of smoke or other detectors, for each particular operation to insure against contamination to the ambient environment, and the operator utilizing the method.

DESCRIPTION OF PREFERRED EMBODIMENT

Figure 1:
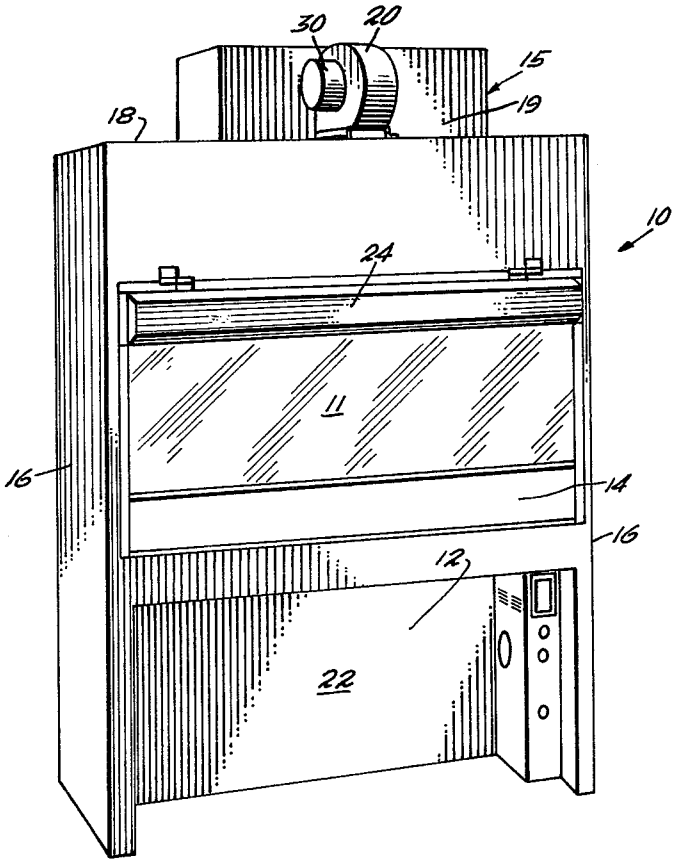
FIG. 1 is a perspective front view of an illustrative total exhaust laminar flow biological fume hood safety cabinet.

Turning now to the accompanying drawings, it will be observed in FIG. 1 that the total exhaust laminar flow biological fume hood safety cabinet 10 is provided with a transparent viewing panel 11 in its front portion. Beneath the transparent viewing panel 11 is an access port 14, shown as a transverse narrow open rectangular portion. Beneath the access port 14, provision is made for a knee space 12, so that the operator sitting before the cabinet 10 can move close to the viewing panel 11 and the legs are not impeded by the lower structure.

An exhaust filter assembly 15 appears at the upper portion of the cabinet 10. The cabinet itself has a pair of opposed parallel end walls 16, a top 18, on which a frame 19 for the exhaust filter 17 (shown in FIGS. 2 and 3) is mounted.

The make-up air is taken from ambient by means of the make-up air blower 20, the same being powered by the make-up air blower motor 30. The entire unit is illuminated by means of the light housing 24, and its contained lights.

As noted in FIG. 3, an exhaust plenum 21 is provided at the rear portion of the unit, delivering the air from the portion rearwardly of the knee wall 22 into the exhaust blower 25 which is provided by the exhaust blower motor 27. The thus exhausted air is passed through the exhaust HEPA filter 17, and thereafter either to an air incinerator, a further scrubbing unit, or to an exterior portion shielded from the operator of the subject cabinet 10.

Figure 2:
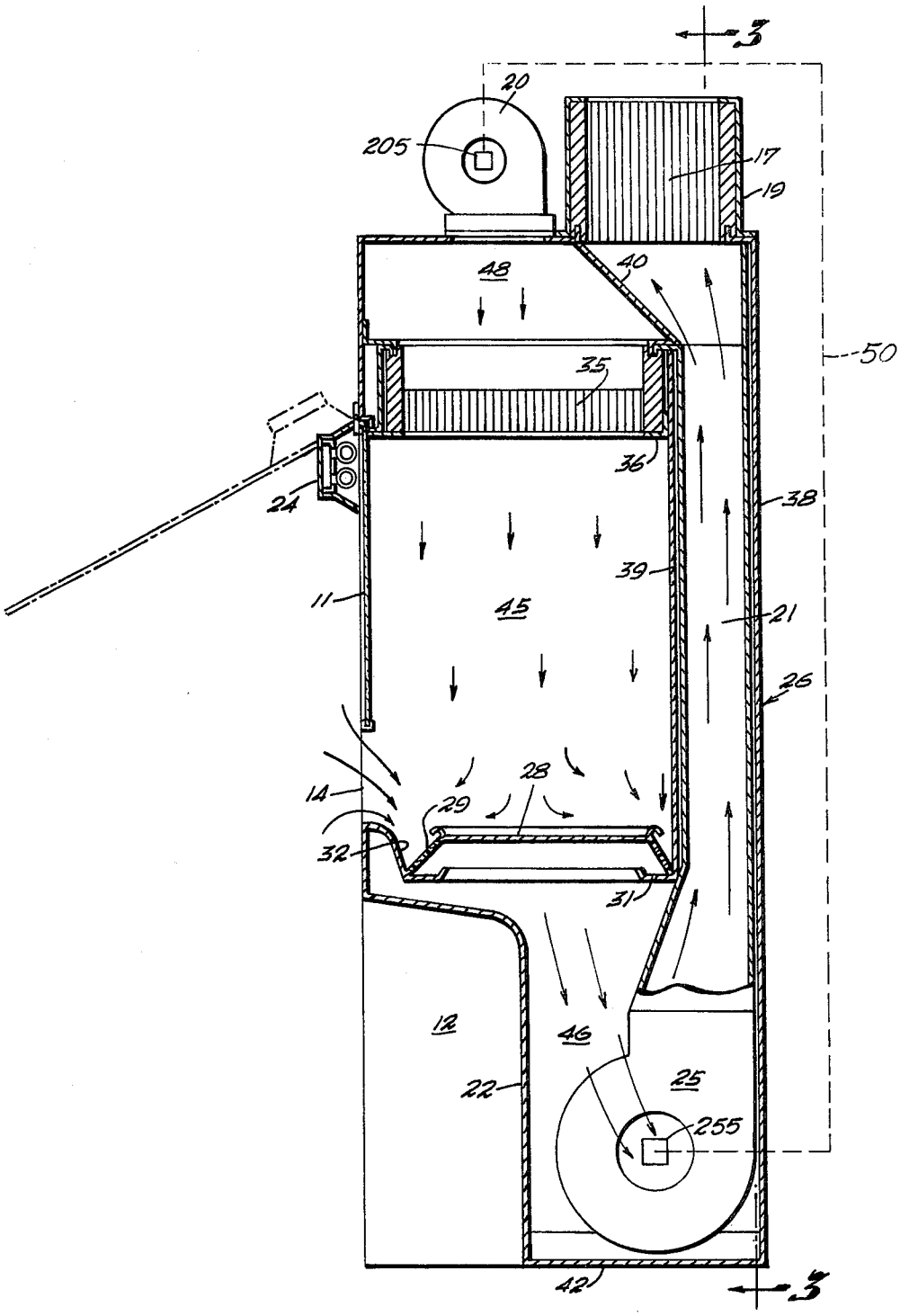
FIG. 2 is a transverse sectional view taken through a mid-portion of the subject cabinet as shown in FIG. 1, and looking towards the left-hand portion thereof, and also showing the viewing panel in phantom lines in its open position.

Turning now to FIG. 2, it will be seen that the work tray 28 is provided above a work tray support 29, the latter being perforated at its front and rear portions, but imperforate at its end portions. In addition to the work tray support 29, a spill pan 31 is provided beneath the work tray 28, and its attendant support 29, so that fluids spilling off of the work tray 28 are directed into the spill pan 31. At the front portion of the unit, immediately beneath the access port 14, provision is made for a spill pan support 32, which also connects the entire unit to the front of the cabinet, to the same degree that the spill pan 31 is connected to the rear portion or intermediate front of the plenum 21 at the rear portion of the work area.

The make-up air is passed into a make-up air HEPA filter 35, immediately beneath the make-up air blower 20. The same is secured in place by means of the frame 36 in which the make-up air filter 35 is mounted. In all instances, the filters 17, 35, are sealed in place, so that all of the air passing through the cabinet 10 is directed through the subject filters. In addition, to further isolate the air, a rear double wall 38 at the rear of the cabinet, as well as an inner double wall 39 are provided so that if there are any leaks from the positive pressure on the interior portion of the exhaust plenum 21, the same will be recirculated and directed again to exhaust, and not passed interiorly into the work chamber 45.

To be noted in particular is the divider 40 which passes transversely across the upper portion of the cabinet 10, and divides the plenum chamber for the exhaust 21 from the make-up chamber 48 which is immediately above the make-up HEPA filter 35. Completing the enclosure of the cabinet, as observed in FIG. 2, is the knee wall 22 provided at the rear portion of the knee space 12, and the base 42. In reviewing the basic elements, therefore, it will be seen that the make-up air passes through the make-up chamber 48 and then into the make-up air HEPA filter 35, thence into the work chamber 45, and thereafter into the exhaust chamber 46 beneath the work tray 28. Once the exhaust chamber 46 is entered by the contaminated air, it is immediately picked up by the exhaust blower 25, and directed through the plenum chamber 21, the exhaust filter 17, and thence to further processing dictated by the particular installation. Furthermore, both the rear 26 and the rear portion of the work chamber 45 are provided with double walls for additional safety.

In a typical successful commercial embodiment, the flow rate through the make-up chamber is approximately 300 cubic feet per minute. The flow rate through the access port 14, is between 450 and 500 cubic feet per minute. This provides a total exhaust of 750 to 800 cubic feet per minute passing through the exhaust filter 17. At the access port 14, the area of the entire access panel being approximately 2.1 square feet, there is a 222 face foot velocity per minute.

The unit is preferably constructed of a 304 stainless steel, although an optional 316 or 316L stainless may be employed. The cabinet 10 is 53 inches wide, 88 inches high, and 33 inches deep. The exhaust filter 17 and frame 19 may be removed for installation purposes, as well as the make-up air blower 20. The exhaust filter is centered on the top with its long axis parallel to the long axis of the unit. The exhaust filter itself is approximately 36 inches long, 12 inches wide, and 11½ inches deep. The filter conforms to Federal specifications 209B HEPA filters. To be noted is the positioning of both of the filters parallel to each other. The make-up air filter 35 is approximately 46 inches wide, 20 inches deep, and a nominal 3 inches across the area through which the air flows. The HEPA filters are substantially 99.99% efficient and, as pointed out above, attached with a positive seal.

The connection between the exhaust motor 27, and the make-up air motor 30 is such that in the event of the failure or reduction in speed of the exhaust motor 27 in comparison to the make-up air motor 30, an alarm is sounded, and the entire unit shut down for decontamination. The shutdown is accomplished by means of switch 25S through the circuit connection 50 (shown in dotted lines) to the switch relay 20S. Preferably, the shut-down is sequential with the make-up air motor 30 being disengaged first, and thereafter the exhaust motor 27.

In review it will be seen that the principle of the operation of the method, as well as the apparatus, is to define a unidirectional, mass-displaced laminar flow of air which bathes the work area with ultra clean air passing through the make-up air HEPA filter 35 first. Thereafter, the make-up air joins the ambient air passing through the access port 14, and entering at sufficient face foot velocity to provide for containment of airborne hazards within the cabinet 10. The ambient air is then directed downwardly so that it does not pass over the work area, and cannot contaminate work in progress.

A 100% exhaust of all air flowing through the cabinet without any recirculation is directed by means of the exhaust plenum 21 to the exhaust filter assembly 15. Further provision can be made to purify the exhausted air by passing it through charcoal or other absorbents, chemical scrubbers, air incinerators, and the like. Otherwise, ducting procedures may be dictated by the particular materials being handled in the hood.

The differential blower motor capacities and filter capacities are controlled to the end that the air flow cubic rate through the access port 14 is equal or optimally greater than that through the make-up filter and sufficient for containment of the make-up air from the work area with is potential biological hazard. When the velocity of the make-up air is approximately 50 lineal feet per minute the velocity of the air provided through the access port 14 is at least 150 lineal feet per minute. The air thereafter passes through the perforate portion of the tray support 29, the same being perforated to substantially 50% of its surface. The speed rates of the two blowers 20, 25 are controlled empirically, but normally to achieve the ratios set forth herinabove. In addition, smoke or other control procedures can be employed to adjust the flow rates with precision to the particular operation and the work being processed. In addition, an anemometer or pitot tube may be placed within the unit to constantly monitor the flow rates, irrespective of the speeds of the inlet air motor 30 and the exhaust air motor 27.

Materials such as high grade stainless steel have been referenced for contruction, it will be appreciated that other materials such as fiberglass, polypropylene, and other imperforate substitutes may be employed. Explosion proof motors are preferable, where an explosive environment is contemplated. In the event duct work is used coupled to the exhaust filter assembly 15, a further explosion proof blower downstream of the same may be required, to constantly accelerate the removal of any explosive or other hazardous materials.

Although particular embodiments of the invention have been shown and described in full here, there is no intention to thereby limit the invention to the details of such embodiments. On the contrary, the intention is to cover all modifications, alternatives, embodiments, usages and equivalents of a total exhaust laminar flow biological fume hood safety cabinet and method as fall within the spirit and scope of the invention, specification and the appended claims.

What is claimed is:

1. A total exhaust laminar flow biological fume hood safety cabinet comprising, in combination, a closed housing having a viewing panel and access port therebeneath at its front portion, an interiorly mounted work tray, means for supporting the work tray and permitting air passage thereabout, a plenum chamber from the lower portion of the housing to the top, an exhaust blower in closed pneumatic communication with the plenum, an exhaust port at the upper portion of the housing and plenum in closed communication with the exhaust blower and plenum, an exhaust filter within the closed communication system coupling the exhaust blower and the plenum, make-up air means at the top of the housing delivering air downwardly over the work tray, filter means downstream of the make-up air means, and a make-up air blower positioned upstream of said filter means comprising the make-up air means, said make-up air blower being powered by a motor, said exhaust blower being powered by a motor, circuit means in combination with the selection of the size and capacity of said blowers and motors proportioned to provide air passing through the access port exceeding the quantity of filtered make-up air and where the access air velocity is at least double the make-up air velocity, said blowers and motors, and said exhaust and make-up air filters having capacity and velocity differentials that are combined so that the excess air velocity and volume exceeds the make-up air velocity and volume, and the exhaust air velocity and volume is a resolution of the sum of both, whereby contaminated air over the work tray is inhibited from passage outwardly through the access port and all air is discharged to exhaust.

2. In the cabinet of claim 1, a diagonal divider between the plenum and the area beneath the make-up air means whereby the make-up air and exhaust filter may be parallel and both above the work tray.

3. In the cabinet of claim 2, perforations in the work tray support approximating one-half the front and rear thereof, the ends being imperforate.

4. In the cabinet of claim 2, switching means between the exhaust blower and make-up air blower to close down both blowers when the exhaust blower velocity decreases below a predetermined ratio with the make-up air blower.

5. In the cabinet of claim 1, perforations in the work tray support approximating one-half the front and rear thereof, the ends being imperforate.

6. In the cabinet of claim 5, switching means between the exhaust blower and make-up air blower to close down both blowers when the exhaust blower velocity decreases below a predetermined ratio with the make-up air blower.

7. In the cabinet of claim 1, switching means between the exhaust blower and make-up air blower to close down both blowers when the exhaust blower velocity decreases below a predetermined ratio with the make-up air blower.

8. A method of purging a work tray for use in handling biohazardous and explosive materials, comprising the steps of positioning the work tray in a confined vertical space and permitting an air passage therebeneath, delivering make-up air passing vertically downward and filtered of particulate matter over the work tray and through said air passage, providing a work opening to the confined vertical space along one edge of the tray which also defines an access port for air, beneath the work tray providing a negative pressure to draw the filtered air over the work tray and through said air passage and to draw air from the access port through said air passage under the work tray at one edge thereof adjacent the opening, confining the air at the terminus of the negative pressure area beneath the work tray in a vertical path substantially parallel to the path of the filtered air passing downwardly over the work tray, and applying further differential pressure to the air at a position beneath the work tray to deliver the same in its confined path vertically and opposed to the particulate filtered air passing downwardly over the work tray, and filtering or otherwise purging the thus defined exhaust air passing vertically and thereafter passing the same to a remote environment separate from the work tray, proportioning the pressure differentials to the end that the velocity and volume of the filtered air passing vertically downward, is less than the velocity and volume of the air passing through the work opening, and the exhaust air velocity and volume is a resolution of the sum of both, whereby total exhaust of air is achieved in an environment wherein contamination to the work room is avoided and the operator may have free access to the work area.

9. In the method of claim 8, proportioning the air velocity to at least two to one between the access port and make-up air.

10. In the method of claim 9, proportioning the air volume so that the access port air is at least 150% of the make-up air.

11. In the method of claim 8, proportioning the air volume so that the access port air is at least 150% of the make-up air.

* * * * *